US005591052A

United States Patent [19]

Watanabe

[11] Patent Number: 5,591,052

[45] Date of Patent: Jan. 7, 1997

[54] CONNECTOR WITH A DOUBLE LOCKING MECHANISM

[75] Inventor: Tamio Watanabe, Shizuoka, Japan

[73] Assignee: Yazaki Corporation, Tokyo, Japan

[21] Appl. No.: 494,245

[22] Filed: Jun. 23, 1995

[30] Foreign Application Priority Data

Jun. 23, 1994 [JP] Japan ..... 6-141978

[51] Int. Cl.[6] ..... H01R 13/514

[52] U.S. Cl. ..... 439/752

[58] Field of Search ..... 439/752, 733, 439/595

[56] References Cited

U.S. PATENT DOCUMENTS

| | | | |
|---|---|---|---|
| 4,319,799 | 3/1982 | Pearce, Jr. | 439/752 |
| 4,804,341 | 2/1989 | Kato et al. | 439/733 |
| 4,946,399 | 8/1990 | Kawashima | 439/752 |
| 5,085,598 | 2/1992 | Kinoshita | 439/752 |
| 5,186,662 | 2/1993 | Yuasa et al. | 439/752 |

FOREIGN PATENT DOCUMENTS

| | | |
|---|---|---|
| 132299 | 10/1989 | Japan . |
| 449229 | 8/1992 | Japan . |

*Primary Examiner*—Gary F. Paumen
*Assistant Examiner*—Eugene G. Byrd
*Attorney, Agent, or Firm*—Sughrue, Mion, Zinn, Macpeak & Seas

[57] ABSTRACT

A locking pin of a connector has slits which are provided through each body 31 of the locking pin, and has bridge elastic portions provided so as to be continuous in the pin insertion direction and so as to have elasticity in the direction to press terminals against walls of terminal accommodating chambers, the locking pin being inserted between the terminals and a wall, opposite to the terminals, of the locking pin insertion hole. Accordingly, the variation in size of the respective portions can be absorbed so that each pin body can be inserted into the locking pin insertion hole easily, and the terminals can be prevented from rattling in the terminal accommodating chambers.

6 Claims, 4 Drawing Sheets

CONNECTOR WITH A DOUBLE LOCKING MECHANISM

BACKGROUND OF THE INVENTION

1. Field of the Invention

The present invention relates to a connector for connecting electric wiring, and particularly relates to an improvement of a connector with a double locking mechanism in which terminals inserted into terminal accommodating chambers of a connector housing are locked doubly so as not to be detached therefrom by a locking means provided in the connector housing and a locking pin inserted into the housing.

2. Related Art

Conventionally, the connection of a pair of electric wirings is performed by fitting, to each other, a pair of male and female terminals attached to the ends of the electric wirings respectively. It is however extremely difficult to connect many wirings pair by pair by use of terminals.

Such a connector has been used, therefore, in which a female connector housing storing a number of male terminals and a male connector housing storing a number of female terminals are fitted to each other to thereby connect a number of wirings at a time.

In such a connector, if terminals are not attached in proper positions in terminal accommodating chambers of male and female connecter housings respectively, wirings cannot be connected accurately when the connector housings are fitted to each other.

In a general connector housing, however, a worker cannot visually determine from the outside whether terminals are attached in their proper positions in terminal accommodating chambers of a connector housing.

Of the different types of connectors, there is a connector with a double locking mechanism in which terminals inserted into terminal accommodating chambers of a connector housing are locked doubly so as not to be detached from the terminal accommodating chambers by a locking means provided in the connector housing and a locking pin inserted into the housing, as disclosed in Japanese Examined Patent Publication No. Hei-4-49229.

The connector with a double locking mechanism disclosed in Japanese Patent Post-Examination Publication No. Hei-4-49229 will be described, by way of example, with reference to FIGS. 5 and 6. In this connector, in FIG. 5, the reference letter M designates a male connector housing, and F a female connector housing. The former stores first and second female terminals A and B in a plurality of terminal accommodating chambers 11 and 12 provided in the form of a matrix while the latter stores first and second male terminals $A_1$ and $B_1$ in terminal accommodating chambers 11 and 12 provided in the positions opposite to the above-mentioned terminal accommodating chambers 11 and 12 respectively.

The male and female connector housings M and F are fitted to each other so that the many female and male terminals A, $A_1$ and B, $B_1$ can be connected at the same time.

Since the male and female connector housing M and F have substantially the same configuration, only the male connector housing M will be described, by way of example, to explain the above-mentioned double locking mechanism. Locking pin insertion holes 19 and 20 are formed in a pair of side surfaces, opposite to each other, of the male connector housing M to thereby communicate with the terminal accommodating chambers 11 and 12 respectively.

A plurality of pin bodies 15 and 16 different in length (the lengths of the pin bodies are adjusted suitably in accordance with the structure of the connector housing) are provided so as to extend from one side surface of a belt-like common substrate 17 of a locking pin 18 as shown in FIG. 5. The pin bodies 15 and 16 are inserted into the holes 19 and 20 respectively.

On the other hand, as shown in the sectional view of FIG. 6 (which is a sectional view along a plane perpendicular to the direction of insertion of the locking pin and which is a sectional view illustrating a portion corresponding to the pin body 15), each female terminal A stored in the terminal accommodating chambers 11 of the male connector housing M is engaged with a locking means 13 provided integrally with a wall dividing the terminal accommodating chambers 11 from another one adjacent thereto, and a concave portion provided suitably in the terminal. The female terminal A is engaged further with the locking pin 15 inserted into the locking pin insertion hole 19 and having, for example, a rhomboidal section. Accordingly, the female terminal A is locked doubly so as not to be detached.

Accordingly, in the connector with such a double locking mechanism, female and male terminals can be accurately positioned in terminal accommodating chamber of connector housings accurately, and can be prevented from being detached. It is therefore possible to make the female and male terminals engage with each other to thereby connect electric wirings accurately to each other when the male and female connector housings are fitted to each other.

Connector housings of the connector with such a double locking mechanism are generally manufactured by injection molding of resin material. This means that variations are apt to appear in the size of terminal accommodating chambers, and so on. In addition, terminals are manufactured by pressing a metal thin plate, and are fixed by caulking end portions of electric wirings. It is therefore impossible to perfectly avoid variation in the outer size thereof.

Further, since the above-mentioned locking pin is generally manufactured by injection molding of resin material, there is a high possibility of variation in size or deformation.

If there is such a variation in size, the locking pin and the terminal do not sufficiently engage with each other when the locking pin is inserted into the locking pin insertion hole, so that there is a fear that a force to prevent the terminal from being detached is reduced, or the terminal rattles in the terminal accommodating chambers by the vibration given to the connector to thereby produce friction in the terminal or the connector housing. On the contrary, there is a case where a force to insert the locking pin into the locking pin insertion hole is so large as to problems in regard to the assembling of the connector.

In order to solve such problems, another structure is proposed in Japanese Utility Model Post-Examination Publication No. Hei-1-32299. In the structure disclosed in this publication, a flexible locking arm 60 supported on one side and covering a concave portion 70 is provided in a horizontal member 63 which is a spacer inserted into a connector housing H, so that each terminal 72 is pressed by the elastic force of the flexible locking arm 60 as shown in FIG. 7.

The above-mentioned problems such as rattling of a terminal, and so on could be solved by such a structure as shown in FIG. 7. A new problem was, however, found.

That is, as the number of terminals stored in a connector housing is increased, it is difficult to ensure that the injected resin reaches the portion corresponding to the free end of the flexible locking arm 60 at the time of molding so that the performance of molding is reduced.

In addition, when a spacer is inserted again after the spacer is once inserted and detached, there is a possibility that the flexible locking arm 60 supported on one side is caught by the terminal.

SUMMARY OF THE INVENTION

Taking the foregoing problems into consideration, the present invention has an object to provide a connector with a double locking mechanism in which a locking pin can be easily inserted into a locking pin insertion hole provided in a connector housing, and the locking pin is engaged with terminals accurately enough to prevent the terminals from rattling in terminal accommodating chambers, and further the locking pin can be easily manufactured by molding, and can be easily detached from the housing when the insertion is performed again, and so on.

The foregoing object can be attained by a connector with a double locking mechanism in which terminals inserted into terminal accommodating chambers of a connector housing are locked and fixed doubly so as not to be detached therefrom by locking means provided in the terminal accommodating chambers, and a locking pin inserted into a locking pin insertion hole from the outer surface side of the connector housing; wherein the locking pin is fitted between the terminals and a wall surface opposite to the terminal, and has bridge elastic portions continuous in the direction of pin insertion so as to have elasticity in the direction to press the terminals against walls of the terminal accommodating chambers.

Preferably, the bridge elastic portions are formed in the locking pin by slits extending in the axial direction of the locking pin are formed in positions so as to be opposite to the terminals when the locking pin is attached to the connector housing.

Preferably, the bridge elastic portions are formed by convex portions of each pin body of the locking pin expanded to contact with the terminals, the pin body having bottom portions expanded in the direction opposite to the convex portions so as to contact with the wall opposite to the terminals in the locking pin insertion hole so that the pin body is corrugated. Accordingly, elasticity is imparted on the locking pin.

A locking pin in a connector with a double locking mechanism according to the present invention is inserted into a locking pin insertion hole provided in a connector housing so as to be engaged with terminals. Accordingly, in cooperation with locking means, it is possible to fix the terminals accurately so as not to be detached from terminal accommodating chambers. In addition, the locking pin has elasticity in the direction to press the terminals against walls of the terminal accommodating chambers. Accordingly, it is possible to absorb the variation in size and shape of the terminals, the terminal accommodating chambers and the locking pin itself so that it is possible to insert the locking pin into the locking pin insertion hole easily.

When the locking pin is fitted between the terminals and the wall opposite to the terminals in the locking pin insertion hole, it is possible to press the terminals against the walls of the terminal accommodating chambers suitably, so that it is possible to prevent the terminals from rattling in the terminal accommodating chambers.

In addition, the structure to press the terminals is formed as bridge elastic portions which are continuous in the direction to insert the locking pin, and injection spaces of a metal mold communicate with each other in the longitudinal direction of a pin body of the locking pin. Accordingly, resin flows smoothly at the time of injection molding.

Since the bridge elastic portions are continuous in the direction of insertion of the locking pin, it is possible to avoid catching the locking pin not only in the direction of insertion of the locking pin but also in the direction of withdrawal of the locking pin.

DETAILED DESCRIPTION OF THE PREFERRED EMBODIMENTS

Embodiments of a connector with a double locking mechanism according to the present invention will be described below in detail with reference to the drawings.

Figure 1:
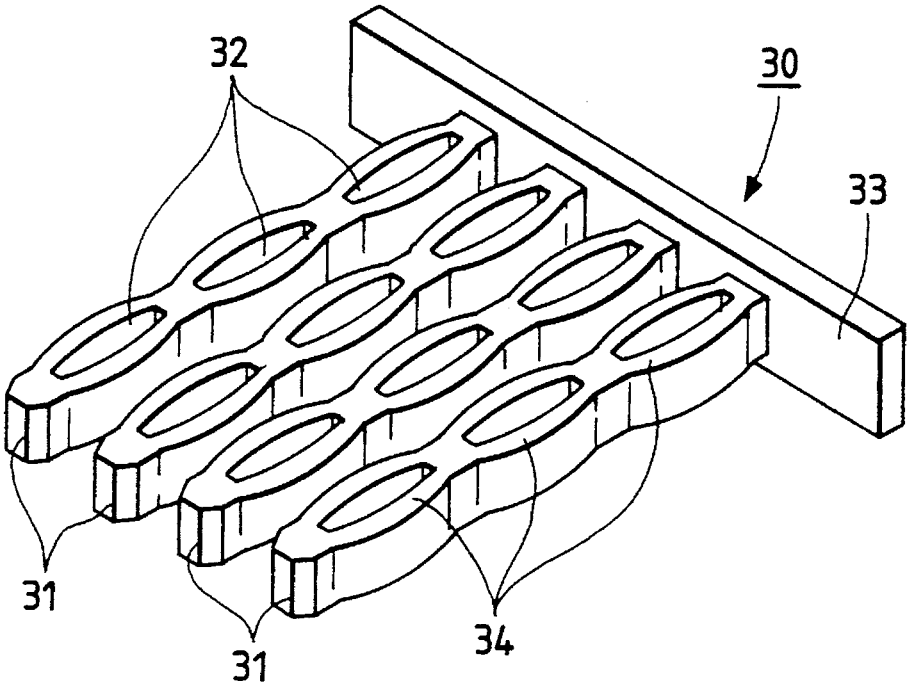
FIG. 1 is a perspective view illustrating a locking pin of a connector with a double locking mechanism of a first embodiment according to the present invention.
Figure 2:
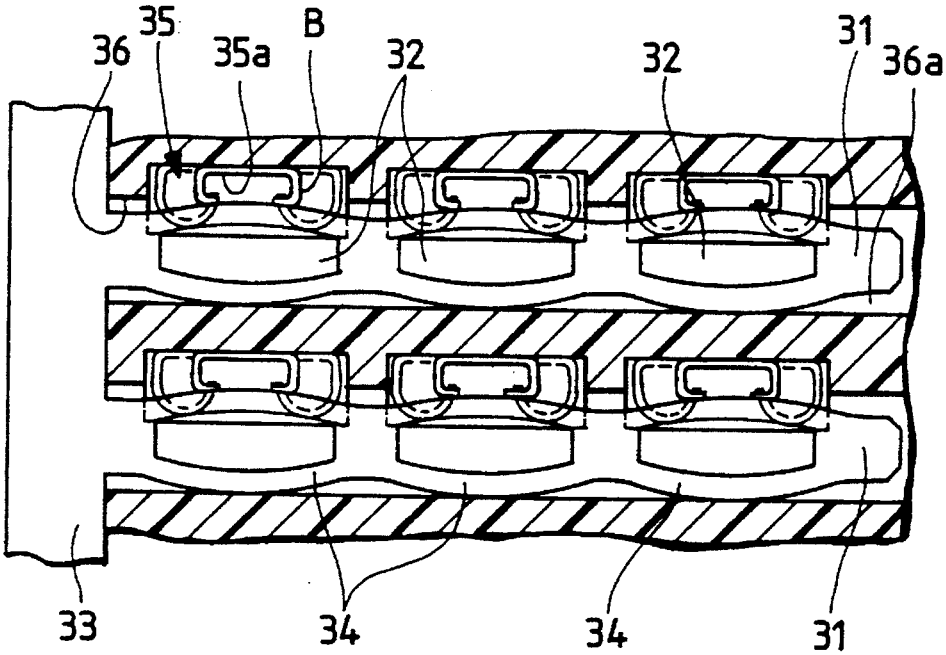
FIG. 2 is a plan sectional view illustrating the engagement relationship between the locking pin and terminals shown in FIG. 1.
Figure 3:
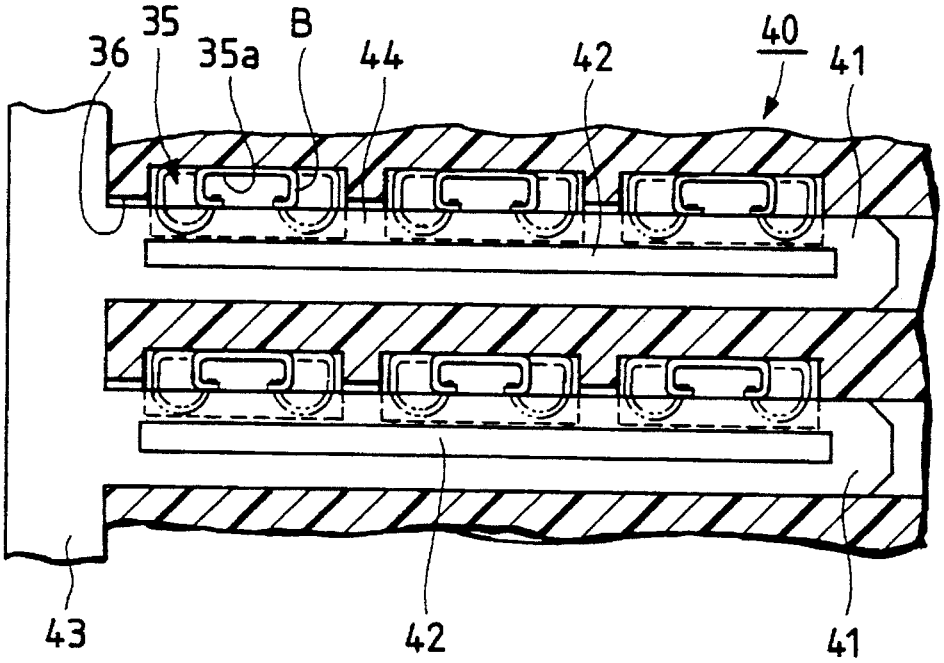
FIG. 3 is a plan sectional view illustrating the engagement relationship between a locking pin and terminal fittings in a connector with a double locking mechanism of a second embodiment according to the present invention.
Figure 4:
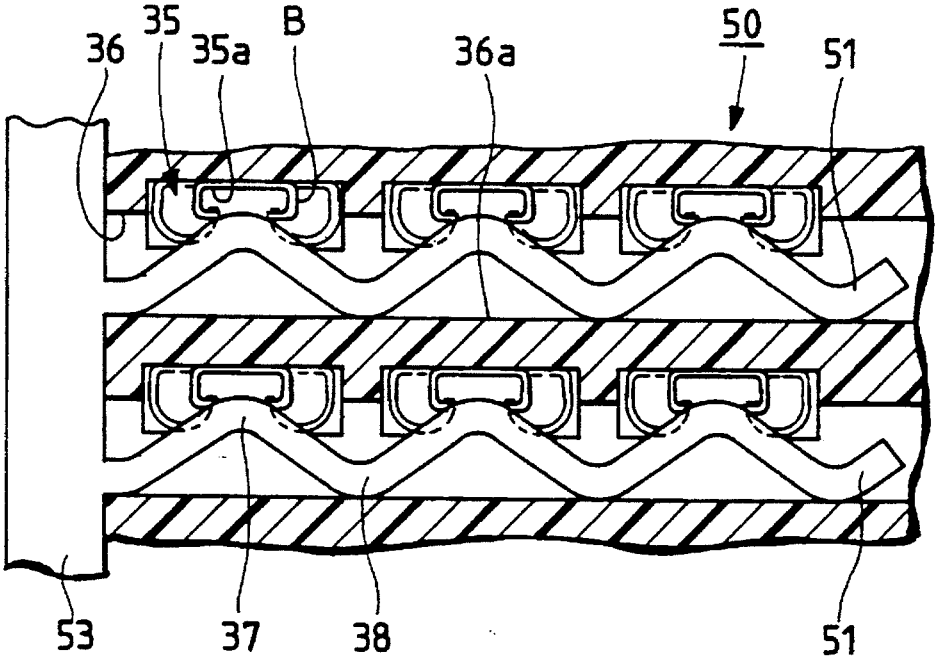
FIG. 4 is a plan sectional view illustrating the engagement relationship between a locking pin and terminals in a connector with a double locking mechanism of a third embodiment according to the present invention.
Figure 5:
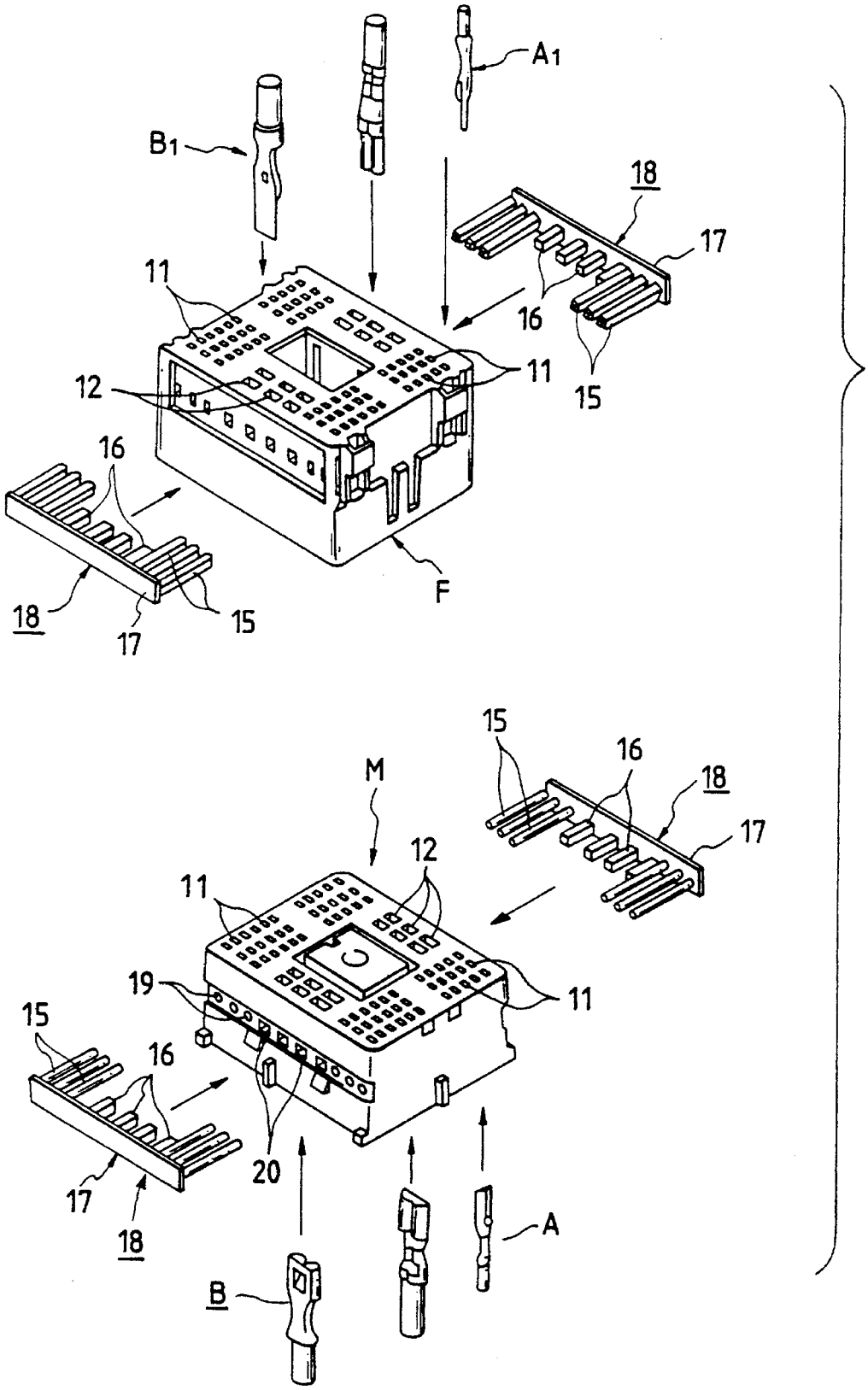
FIG. 5 PRIOR ART
FIG. 5 is a whole perspective exploded view illustrating a conventional double locking connector.
Figure 6:
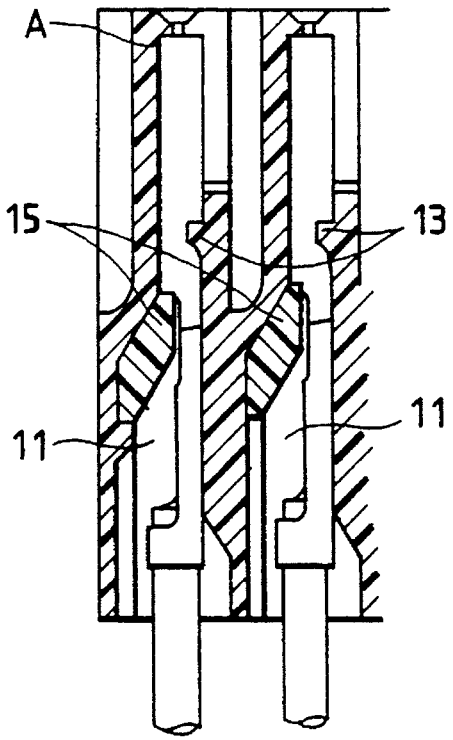
FIG. 6 PRIOR ART
FIG. 6 is a vertical sectional view illustrating the engagement relationship between a locking pin and terminals in the double locking connector shown in FIG. 5.
Figure 7:
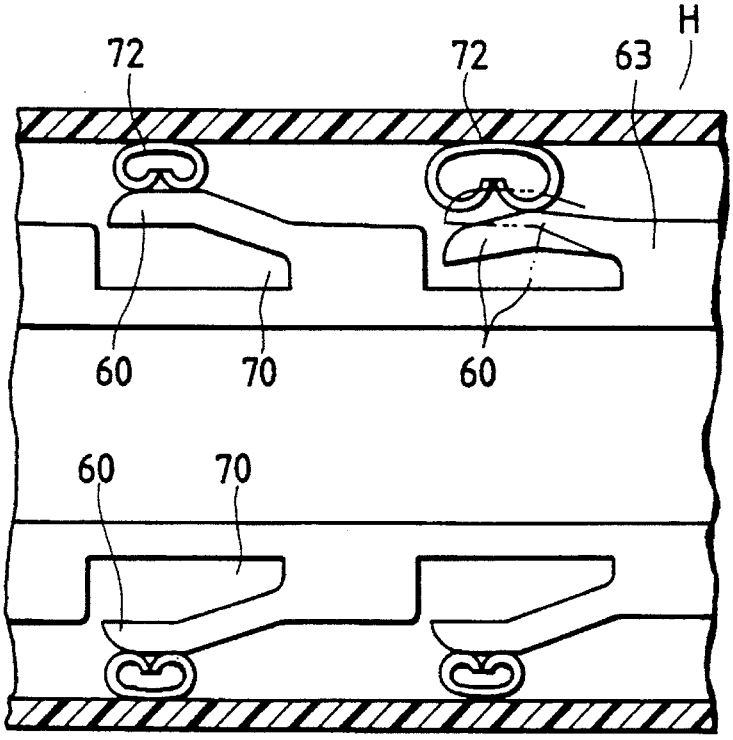
FIG. 7 PRIOR ART
FIG. 7 is a partially sectional view of a conventional double locking connector.

FIG. 1 is a perspective view illustrating a locking pin of a connector with a double locking mechanism of a first embodiment according to the present invention; FIG. 2 is a plan sectional view illustrating the engagement relationship between the locking pin and terminals shown in FIG. 1; FIG. 3 is a plan sectional view illustrating the engagement relationship between a locking pin and terminal fittings in a connector with a double locking mechanism of a second embodiment according to the present invention; and FIG. 4 is a plan sectional view illustrating the engagement relationship between a locking pin and terminals in a connector with a double locking mechanism of a third embodiment according to the present invention.

First embodiment

A connector with a double locking mechanism of a first embodiment has substantially the same structure as that of the above-mentioned connector with a double locking mechanism disclosed in the conventional art. Therefore, the shape of the locking pin will be described below in detail with reference to FIGS. 1 and 2.

As shown in the perspective view of FIG. 1, a locking pin 30 of the connector with a double locking mechanism of this embodiment is manufactured by injection molding of resin materials so that a plurality of pin bodies 31 having a rectangular or rhomboidal section are arranged vertically on one side surface of a belt-like common substrate 33 in the longitudinal direction of the common substrate 33.

As shown in FIG. 2, a plurality of slits 32 extending in the axial direction of the respective pin bodies 31 are provided in the positions opposite to terminals B when the pin body 31 is attached into a locking pin insertion hole 36. In addition, bridge elastic portions 34 expanded in the width (outward) direction of the pin body 31 are formed. Therefore, these bridge elastic portions 34 are opposite to the terminals B respectively, so that the bridge elastic portions 34 can bend suitably toward the slits 32. Accordingly, if the width of the pin body 31 is established so as to be slightly oversized, the pin body 31 can fix the terminals B elastically in the direction to press the terminals B against walls 35*a* of terminal accommodating chambers 35 respectively.

In the locking pin 30 of this embodiment, the pin body 31 can be inserted into the locking pin insertion hole 36 while the pin body 31 absorbs the variation in of the size of the terminals B, the terminal accommodating chambers 35 and the pin body 31 itself. It is therefore possible to insert the pin body 31 into the locking pin insertion hole 36 easily.

Further, the pin body 31 inserted between the terminals B and the wall 36*a* of the locking pin insertion hole 36 presses the terminals B onto the walls 35*a* of the terminal accommodating chambers 35, so that it is not only possible to prevent the terminals B from rattling in the terminal accommodating chambers 35 even if vibrations are imposed on the connector, but also it is possible to prevent the terminals B from being detached from the terminal accommodating chambers 35 since the pin body 31 engages with the terminals B accurately.

In addition, the structure used to press the terminals B corresponding as the bridge elastic portions 34 is continuous in the pin insertion direction, so that resin can flow smoothly at the time of injection molding. Further, since the bridge elastic portions 34 are continuous in the pin insertion direction, the locking pin 30 will not become stuck in the direction of detachment of the locking pin 30.

Second embodiment

As shown in FIG. 3, a locking pin 40 of a connector with a double locking mechanism of a second embodiment has the same structure as that of the above the first embodiment, with the exception that the three slits 32 which are provided separately from each other in each pin body 31 of the locking pin 30 of the above Embodiment 1 are replaced by one slit 42 as if the three slits are communicated with each other to thereby form a large bridge elastic portion 44.

Consequently, in the locking pin 40 of this embodiment, the quantity of the locking pin 40 bent in the direction to press terminals B onto walls 35*a* of terminal accommodating chambers 35 can be made larger than that of the locking pin 30 of Embodiment 1. Accordingly, it is possible to insert pin bodies 41 into locking pin insertion holes 36 more easily.

Even if, for example, the terminals B are made smaller in size and the distance between them is made narrower, it is not necessary to arrange the slits accurately in accordance with the positions of the terminals B, and it is possible to press all the terminals B onto the walls 35*a* of the terminal accommodating chambers 35 accurately.

Third embodiment

In a locking pin of a connector with a double locking mechanism of a third embodiment, the shape of each pin body is made quite different from that of the first and second embodiment.

That is, as shown in FIG. 4, each pin body 51 of a locking pin 50 of this embodiment has bridge elastic portions 37 formed in convex portions swelling so as to contact with terminals B, and bottom portions 38 swelling in the direction opposite to these convex portions so as to contact with a wall 36*a* opposite to the terminals B in a locking pin insertion hole 36, so that the pin body 51 as a whole has a corrugated shape. This locking pin 50 has a corrugated shape established to have enough elasticity in the direction to press the terminals B against walls 35*a* of terminal accommodating chambers 35.

Consequently, even if there is a large variation in the size of the terminals B, the terminal accommodating chambers 35 and the pin body 51 itself, the pin body 51 of the locking pin 50 of this embodiment can press the terminals B onto the walls 35*a* of the terminal accommodating chambers 35 while the pin body 51 absorbs the variation in size. Accordingly, not only it is possible to prevent the terminals B from rattling in the terminal accommodating chambers 35 when vibrations are imposed on the connector, but also it is possible to prevent the terminals B from being detached from the terminal accommodating chambers 35 since the pin body 51 is engaged with the terminals B accurately. In addition, the portions of the pin body 51 which contact with the terminals B are shaped into convex portions of a corrugated shape, so as to contact with the terminals B smoothly. Accordingly, it is possible to insert the locking pin 51 into the locking pin insertion hole 36 extremely easily. In addition, the corrugated shape of the pin body 51 is not complicated, so that resin flows more smoothly at the time of molding even in comparison with that in the above two Embodiments.

As has been described, in a connector with a double locking mechanism according to the present invention, terminals stored in terminal accommodating chambers of a connector housing are locked and fixed doubly so as not to be detached by means of a locking means provided in the connector housing and a stick-like locking pin inserted into a locking pin insertion hole bored in the connector housing. Accordingly, it is possible to prevent the terminals from being detached from the terminal accommodating chambers accurately.

In addition, the locking pin of the connector with a double locking mechanism according to the present invention has elasticity in the direction to press the terminals against walls of the terminal accommodating chambers, so that it is possible to absorb the variation in size of the terminals, the terminal accommodating chambers and the locking pin itself. Accordingly, not only it is possible to insert the locking pin into the locking pin insertion hole easily, but also it is possible to prevent the terminals from rattling in the terminal accommodating chambers when vibrations are imposed on the connector since the locking pin inserted between the terminals and the wall opposite to the terminals in the locking pin insertion hole presses the terminals against the walls of the terminal accommodating chambers. Therefore, according to the present invention, it is not only possible to easily insert the locking pin of the connector with a double locking mechanism into the locking pin insertion hole provided in the connector housing, but it is also possible to engage the locking pin with the terminals accurately, so that it is possible to prevent the terminals from rattling in the terminal accommodating chambers. Further, the structure to press the terminals is formed as bridge elastic portions continuous in the pin insertion direction, so that injection spaces of a metal mold communicate with each other in the longitudinal direction of the pin body of the locking pin. Accordingly, resin flows smoothly at the time of injection molding, so that it is possible to avoid the decrease of the performance of molding of the locking pin even in the case where a number of bridge elastic portions are formed corresponding to the number of terminals. Further, the bridge elastic portions are continuous in the pin insertion direction, so that it is possible to avoid catching the locking pin both in the insertion direction and in the direction of detachment. Accordingly, for example, it is possible to easily perform reinsertion of the locking pin, and so on.

What is claimed is:

1. A connector with a double locking mechanism comprising:

a connector housing having a plurality of terminal accommodating chambers;

terminals insertable into said terminal accommodating chambers, respectively;

locking means for fixing said terminals in said terminal accommodating chambers, respectively, said locking means being provided within said terminal accommodating chamber; and a locking pin detachably insertable into a locking pin insertion hole in an insertion direction from an outer side surface of said connector housing, said insertion hole being positioned between said terminals and a wall surface opposing said terminal, wherein said locking pin includes bridge elastic portions having elasticity in a direction normal to said insertion direction so as to press said terminals against an interior wall of said terminal accommodating chamber and wherein said bridge elastic portions are continuous and smooth without any cantilever-type fingers projecting therefrom in said insertion direction.

2. A connector with a double locking mechanism according to claim 1, wherein said locking pin has slits extending in the axial direction of said locking pin so as to define said bridge elastic portions, said slits being positioned so as to oppose said terminals when said locking pin is attached to said connector housing.

3. A connector with a double locking mechanism according to claim 1, wherein said locking pin has a corrugated configuration including a plurality of first convex portions on one side thereof and a plurality of second convex portions on an opposite side thereof, wherein said plurality of first convex portions respectively define said bridge elastic portions and said plurality of second convex portions abut against said opposing wall surface.

4. The connector with a double locking mechanism according to claim 1, wherein said insertion pin includes connecting portions which interconnect adjacent bridge elastic portions.

5. The connector with a double locking mechanism according to claim 4, wherein said bridge elastic portions include arcuate walls, opposite ends of said walls be joined to adjacent said connecting portions.

6. The connector with a double locking mechanism according to claim 5, wherein said arcuate walls have a convex shape so as to elastically abut against said terminals when said insertions pin is fully inserted into said connector housing.

* * * * *